US008430072B2

(12) United States Patent
Burkhard et al.

(10) Patent No.: US 8,430,072 B2
(45) Date of Patent: Apr. 30, 2013

(54) DEVICE AND METHOD FOR CONTROLLING VALVES

(75) Inventors: Sascha Burkhard, Kronshagen (DE); Udo Schlemmer-Kelling, Molfsee (DE); Jurgen Nagel, Gettorf (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 286 days.

(21) Appl. No.: 12/740,781

(22) PCT Filed: Oct. 30, 2008

(86) PCT No.: PCT/EP2008/009183

§ 371 (c)(1),
(2), (4) Date: Apr. 30, 2010

(87) PCT Pub. No.: WO2009/056323

PCT Pub. Date: May 7, 2009

(65) Prior Publication Data

US 2010/0263612 A1 Oct. 21, 2010

(30) Foreign Application Priority Data

Oct. 31, 2007 (EP) ..... 07021291

(51) Int. Cl.
*F01L 1/34* (2006.01)
*F01L 9/02* (2006.01)
*F01L 1/18* (2006.01)

(52) U.S. Cl.
USPC ..... 123/90.15; 123/90.16; 123/90.39; 123/90.41; 123/90.42; 123/90.12

(58) Field of Classification Search ..... 123/90.39, 123/90.16, 90.12, 90.4, 90.43, 90.46, 90.22; 74/559, 569; 29/888.2
See application file for complete search history.

(56) References Cited

U.S. PATENT DOCUMENTS

| | | | | |
|---|---|---|---|---|
| 5,794,589 | A * | 8/1998 | H.ang.kansson | 123/321 |
| 6,510,824 | B2 * | 1/2003 | Vorih et al. | 123/90.12 |
| 6,988,474 | B2 * | 1/2006 | Itoafa | 123/90.44 |
| 7,255,075 | B2 * | 8/2007 | Cornell et al. | 123/90.12 |
| 7,845,327 | B2 * | 12/2010 | Tallio et al. | 123/90.52 |
| 7,882,810 | B2 * | 2/2011 | Vanderpoel et al. | 123/90.12 |

(Continued)

FOREIGN PATENT DOCUMENTS

| | | | |
|---|---|---|---|
| DE | 10239750 | A1 | 3/2004 |
| EP | 1447638 | A1 * | 4/2004 |

(Continued)

*Primary Examiner* — Thomas Denion
*Assistant Examiner* — Stephen D Shipe

(57) ABSTRACT

An apparatus for controlling valve displacement of an internal combustion engine comprises a rocker arm having a first arm portion and a second arm portion, said rocker arm being pivotable about a pivot interposed between said first and second arm portions. The apparatus further comprises an actuation arrangement adapted to actuate said first arm portion of said rocker arm and a valve arrangement adapted to be actuated by said second arm portion of said rocker arm. A damper arrangement is pivotably connected to said first arm portion and adapted for damping movement of said rocker arm around said pivot.

15 Claims, 7 Drawing Sheets

U.S. PATENT DOCUMENTS

| | | | | |
|---|---|---|---|---|
| 8,091,522 | B2 * | 1/2012 | Minato et al. | 123/90.12 |
| 2003/0098000 | A1 | 5/2003 | Vorih et al. | |
| 2003/0116124 | A1 | 6/2003 | Lawrence et al. | |
| 2003/0221644 | A1 | 12/2003 | Barnes et al. | |
| 2004/0065285 | A1 | 4/2004 | Uludogan et al. | |
| 2004/0118368 | A1 | 6/2004 | Hefler | |
| 2004/0250783 | A1 * | 12/2004 | Robel et al. | 123/90.16 |
| 2005/0121008 | A1 | 6/2005 | Kilkenny et al. | |
| 2005/0121637 | A1 | 6/2005 | Adams et al. | |

FOREIGN PATENT DOCUMENTS

| | | | |
|---|---|---|---|
| EP | 1477638 | A1 | 11/2004 |
| EP | 1477638 | A1 * | 11/2004 |
| WO | 87/07677 | | 12/1987 |
| WO | 2004/005677 | A1 | 1/2004 |

* cited by examiner

DEVICE AND METHOD FOR CONTROLLING VALVES

CROSS-REFERENCE

The present application claims priority to European patent application No. 07021291.5, filed 31 Oct. 2007, which is incorporated herein by reference as if fully set forth herein, and is the national stage of PCT/EP2008/009183, filed Oct. 30, 2008.

TECHNICAL FIELD

The present disclosure relates to an apparatus for controlling valve displacement of an internal combustion engine and, more particularly, to an apparatus for adjusting or delaying the closing of inlet valves of an internal combustion engine, in particular diesel and gasoline engines.

BACKGROUND

In order to reduce NOx emissions from diesel and gasoline engines, it is known to use the "Miller process" to cool or reduce the combustion temperature. According to this process, a cooling effect is achieved by closing the intake valves very early. The subsequent expansion of the volume of gas in the combustion chamber lowers the temperature of the fresh gas mixture and the cylinder filling loss of the charged engine is compensated by an increased charging pressure generated by a turbocharger.

For transient engine conditions, in which the loaded engine must generate increased power/torque within a short time, shutting-off the Miller process is very helpful. This can be achieved by displacing the inlet cam profile by rotating the cam shaft relative to the crankshaft or by displacing the cam on the cam shaft or by modifying the coupling of the cam/valve. In all cases, a valve-opening overlap and thus evacuation of the cylinders is reduced by displacing the cam profile.

In EP 1 477 638 A1A, a device for variably controlling the opening and/or closing of inlet and/or exhaust valves of an internal combustion engine of the above-mentioned type is disclosed. This known device is adapted to delay the closing of inlet valves of an internal combustion engine, and includes a damping device integrated in a guide rod for guiding a valve actuation bridge during its up and down motion. Hence, the damping device is an integrated part of the valve actuation bridge. More particularly, in this known device, an annular recess is disposed between a guide rod of a piston and a cylinder sleeve. The annular recess is in fluid communication with an axial bore axially extending within the guide rod via a transverse bore. One end of a tap bore opens or discharges into the axial bore of the guide rod. The other end of the tap bore is in fluid communication with valve units via oil-supply lines. More particularly, the tap bore is connectable with a lubricating oil-supply port as a function of the valve position of the gas exchange valves either via a first oil-supply line controlled by a valve unit, which includes a passage and shutoff valve, or via a second oil-supply line controlled by a second valve unit, which includes a one-way valve and a throttle. Thus, controlling of the gas exchange valves as a function of the closed position and/or the opened position can be achieved by means of the valve units having the correspondingly-designed valves.

When the gas exchange valves are closed, lubricating oil contained in the annular recess can be supplied into a further valve unit via the axial bore and the tap bore, as well as via an oil-supply line. In addition, when the valve is closed, the lubricating oil can be supplied into the valve unit having the throttle so that the intake valves will assume a delayed position. In contrast, when the gas exchange valves are in a delayed position, the free or terminal end of the rocker arm that is opposite of the valve actuation bridge is pivoted about the rotational axis towards the rocker arm by means of a telescoping member, which is spring-biased and guided in the push-rod, without any play or clearance therebetween.

However, the device disclosed in EP 1 477 638 A1 requires construction space between the two inlet and/or exhaust valves and its associated springs. Furthermore, due to the integration of the damping device in the guide rod of the valve actuation bridge, the known device requires a guide rod.

U.S. Pat. No. 3,520,287 discloses an exhaust valve control for an engine braking system which also includes an arrangement having a guide rod slidably mounted on a valve actuation bridge. The valve actuation bridge and the guide rod together define a hydraulic chamber that expands when the valve bride advances to open the exhaust valves and contracts when the valve actuation bridge retracts to permit the two exhaust valves to be closed by the exhaust valve springs. Again, a damping device is integrated into the guide rod and is part of the valve actuation bridge. Hence, like the above arrangement, a construction space between the two valves is necessary and this known assembly requires a guide rod.

U.S. Pat. No. 6,905,155 discloses an apparatus for limiting the travel of a slave piston in a slave piston cylinder in a compression release engine retarder. The apparatus is connected to a hydraulic circuit and an internal passageway is defined in the slave piston head. The internal passageway comprises a vertical bore, a horizontal bore and an annular channel which together define a path for bleeding off the pressure at the top of the slave piston when the annular channel and an aperture in the slave piston cylinder are aligned. By bleeding off the hydraulic pressure at top of the slave piston, the motion of the slave piston is restricted to a desired stroke. The apparatus includes a locking adjustable foot on the slave piston stem which provides a means for adjusting the lash. Here, the known arrangement for actuating at least one engine valve requires a minimum space above the valve actuation bridge and the rocker arm.

US 2005/0121008 A1 discloses a method and apparatus for controlling a temperature in a combustion cylinder in an internal combustion engine. A rocker arm is located to move about a pivot. A push-rod provides a mechanical force against the rocker arm. An electro-hydraulic assist actuator may include a plunger assembly for providing a hydraulic force used to vary the open duration of an intake valve. In particular, the electro-hydraulic assist actuator may be used to hold the intake valve open for a period of time longer than a cam is designed to do. The plunger assembly may be located at the same side of the rocker arm as the push rod. In addition, the plunger assembly is designed to provide a mechanical force during a first rotating direction of the rocker arm. A reverse rotating direction of the rocker arm has no impact on the plunger assembly. Consequently, the known plunger assembly may be relatively slow and the reaction time could be relatively long.

US 2003/0221644 A1 shows a similar engine valve actuation system including a fluid actuator configured to selectively prevent an intake valve from moving in a first position.

Other arrangements are known from, e.g., DE 102 39 750 A1, US 2005/0121637, US 2004/0065285 A1, WO 2004/005677 A1, WO 87/07677.

The present disclosure is directed, at least in part, to improving or overcoming one or more aspects of prior devices and methods for controlling valves and, more particularly, of apparatus for adjusting or delaying the closing of inlet valves of an internal combustion engine.

SUMMARY OF THE DISCLOSURE

According to a first exemplary aspect of the present teachings, an apparatus for controlling valve displacement of an internal combustion engine comprises a rocker arm having a first arm portion and a second arm portion, said rocker arm being pivotable about a pivot interposed between said first and second arm portions. Said apparatus further comprises an actuation arrangement adapted to actuate said first arm portion of said rocker arm and a valve arrangement adapted to be actuated by said second arm portion of said rocker arm. A damper arrangement may be pivotably connected to said first arm portion and adapted for damping movement of said rocker arm around said pivot.

In a further exemplary embodiment of the disclosed apparatus said rocker arm may be pivotable about the pivot in a first rotating direction and a second rotating direction which is reverse to the first rotating direction. Said damper arrangement may be hydraulically operated by means of a hydraulic fluid and pivotably connected to said first arm portion so that movement in said first rotating direction of said rocker arm around said pivot is damped and during movement in said second rotating direction of said rocker arm said hydraulic fluid is sucked. The suction of the hydraulic fluid may be caused by the movement in said second rotating direction of said rocker arm and the pivotable or articulated or hinged connection of the damper arrangement to the rocker arm.

A further exemplary embodiment may comprise a push-rod adapted to be reciprocated, e.g. by a valve cam and a rotational drive, a rocker arm pivotable about a rotational axis, a valve actuation bridge and a damper arrangement adapted to damp the pivoting motion of the rocker arm during movement of valves, preferably during a closing of one or more of the engine valves. In this exemplary embodiment a first arm portion of the rocker arm extends from the rotational axis to a first free end of the rocker arm and a second arm portion of the rocker arm extends from the rotational axis to a second free end of the rocker arm opposite the first free end. The first arm portion of the rocker arm may be driven by the push-rod. The valve actuation bridge may be driven by the second arm portion of the rocker arm and may connect to respective valve shafts of the valves. The damping device acts on the first arm portion of the rocker arm driven by the push-rod. The valves may comprise one or more inlet valves and/or one ore more outlet valves. In one exemplary embodiment of the present teaching the damper arrangement causes a delay of the closing of inlet valves.

According to another exemplary aspect of the present teachings, a method of controlling at least one combustion chamber valve associated with a rocker arm may comprise rotating said rocker arm about a pivot interposed between first and second arm portions for actuating at least one combustion chamber valve and damping the rotation of said rocker arm with a damper arrangement jointly connected to said first portion of said rocker arm. According to a further exemplary embodiment of the disclosed method, the method may further comprise rotating said rocker arm about said pivot in a first rotating direction and simultaneously applying a force to said first arm portion of said rocker arm so that movement of said rocker arm around said pivot in said first pivoting direction is damped. Rotating the rocker arm about said pivot in a second rotating direction which is reverse to said first rotating direction may cause sucking said hydraulic fluid.

According to another exemplary aspect of the present teachings, a method of controlling at least one combustion chamber valve associated with a rocker arm may comprise rotating said rocker arm about a pivot interposed between first and second arm portions for actuating at least one combustion chamber valve and damping rotation of said rocker arm with a damper arrangement connected to said first portion of said rocker arm.

According to another exemplary aspect of the present teachings, an internal combustion engine comprises an apparatus for controlling valve displacement of said internal combustion engine. Said apparatus includes a rocker arm, said rocker arm being pivotable about a pivot interposed between first and second arm portions. Furthermore, an actuation arrangement for applying a force to said first arm portion of said rocker arm and a valve arrangement actuated by said second arm portion of said rocker arm are comprised. Finally, a damper arrangement is pivotably connected to said first arm portion and damps a movement of said rocker arm around said pivot.

As utilized herein, the terms "damping unit" and "damper arrangement" or similar terms used throughout the description are intended to cover any kind of apparatus/device that imparts a resistive decelerating force to the reciprocating movement of any kind of valves.

Representative, but not limiting, examples of suitable damper arrangements in accordance with the present teachings may include hydraulic and pneumatic cylinders, such as e.g. utilized for shock absorbing applications. In some embodiments, a spring or other resilient elastic materials or devices may be suitably utilized, particularly, if the elastic return force can be changed in operation.

Other features and aspects of this disclosure will be apparent from the following description and the accompanying drawings.

It is to be understood that forgoing general description and the following detailed description are exemplary and explanatory only and are not restrictive of the present disclosure.

BRIEF DESCRIPTION OF THE DRAWINGS

The accompanying drawings, which are incorporated in and constitute a part of the specification, illustrate an exemplary embodiment of the disclosure and, together with the description, serve to explain the principles of the disclosure. In the drawings.

DETAILED DESCRIPTION

Figure 1:
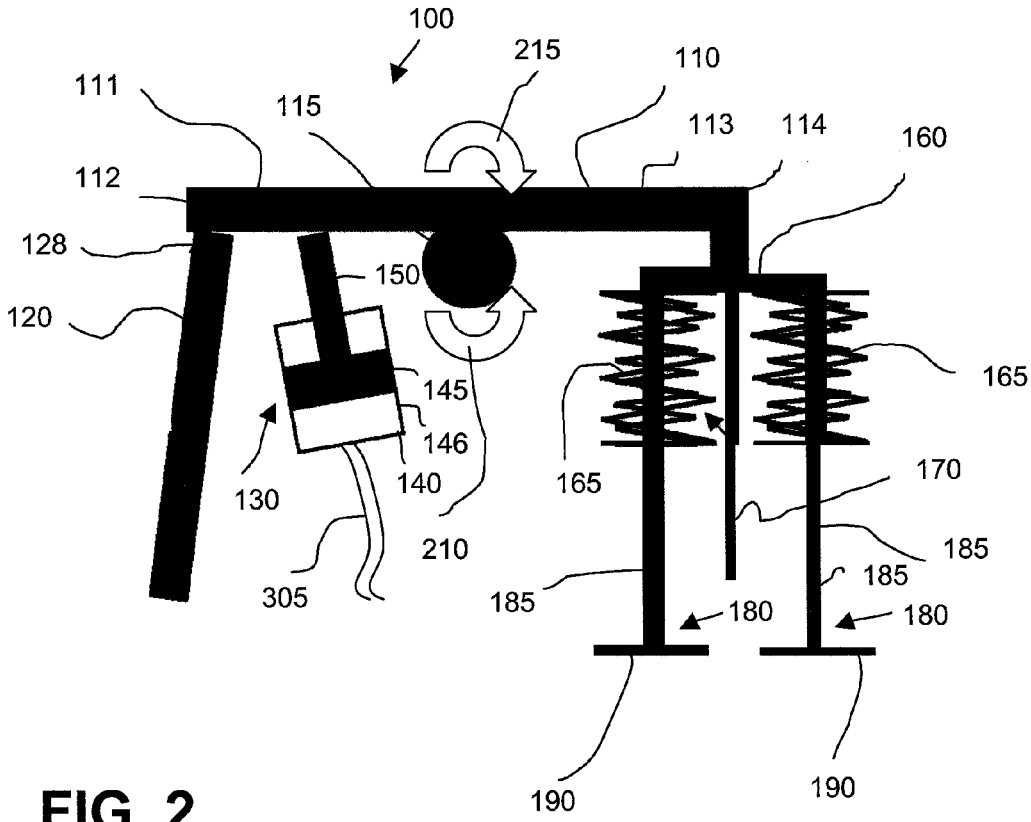
FIG. 1 is a schematic illustration of a first preferred exemplary device for variably controlling the closing of inlet and/or exhaust valves of an internal combustion engine.

Reference will now be made in detail to the exemplary embodiments of the present teachings, examples of which are illustrated in the accompanying drawings. Wherever possible, the same reference numerals will be used throughout the drawings to refer to the same or like parts.

Referring to FIG. 1, an exemplary device 100 for variably controlling the opening and/or closing of inlet and/or exhaust valves 180 of an internal combustion engine (not shown), for example, a four-stroke diesel engine, is provided. The valve control device 100 may include a rocker arm 110 that may be rotatable about a rotational axis 115. The rocker arm 110 has a first arm portion 111 extending from the rotational axis 115 to a first free end 112 of the rocker arm 110, and a second arm portion 113 extending from the rotational axis 115 to a second free end 114 of the rocker arm 110. The second free end 114 is opposite the first free end 112 of the rocker arm 110.

In addition, the valve control device 100 may include an actuation arrangement. This actuation arrangement may comprise a push-rod 120. A free end 128 of the push-rod 120 may be in contact with the free end 112 of the rocker arm 110. The push-rod 120 may be driven by any arrangement. In one exemplary embodiment the push-rod 120 may be driven by a valve cam (not shown) and a rotational drive (not shown). However, since such a drive device for of the push-rod 120 is well known, a detailed explanation of this kind of drive device is omitted.

As shown in FIG. 1, a valve actuation bridge 160 may be in contact with the second free end 114 of the rocker arm 110. The valve actuation bridge 160 may have a guide rod 170 for guiding the valve actuation bridge 160 during up-and-down reciprocating motion for opening and/or closing the inlet and/or exhaust valves 180. The valve actuation bridge might be omitted if e.g. only one valve is to be actuated.

The exhaust valves 180 may include valve discs 190 and valve shafts 185. In one exemplary embodiment the valve shafts 185 are coupled with the valve actuation bridge 160. A helical spring 165 may be arranged on each valve shaft 185 for urging the valve discs 190 towards respective valve seats 191 (see e.g. FIG. 5).

Furthermore, the valve control device 100 may include a damper arrangement or damping unit 130 for applying a damping force to the first rocker arm portion 111 of the rocker arm 110 during pivoting of the rocker arm 110 in a first pivoting direction shown by arrow 210. By pivoting of the rocker arm 110 in the first pivoting direction of the arrow 210, the valves 180 may be forced towards their respective valve seats 191 (see FIG. 5) and therefore in the direction for closing the valves 180. The arrow 215 illustrates a second pivoting direction of the rocker arm 110 about the rotational axis 115 for opening the valves 180, i.e. the valve discs 190 move away from their respective valve seats 191. The damping unit 130 may include a piston 145 having a piston-rod 150. In one exemplary embodiment the piston 145 is slidably supported in a housing 146. The piston 145, in combination with the housing 146, may define a fluid chamber 140 which is in fluid communication via an oil-supply line 305 with a hydraulic system 300 schematically shown in FIG. 2.

Figure 2:
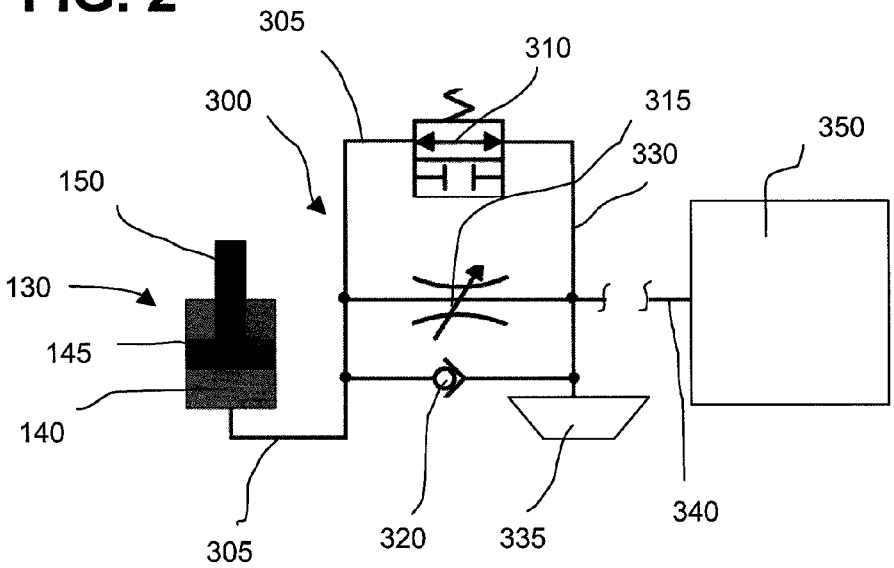
FIG. 2 is a schematic diagram of the hydraulic system connected to a damping unit as part of the exemplary device for variably controlling the closing of inlet and/or exhaust valves shown in FIG. 1.
Figure 3:
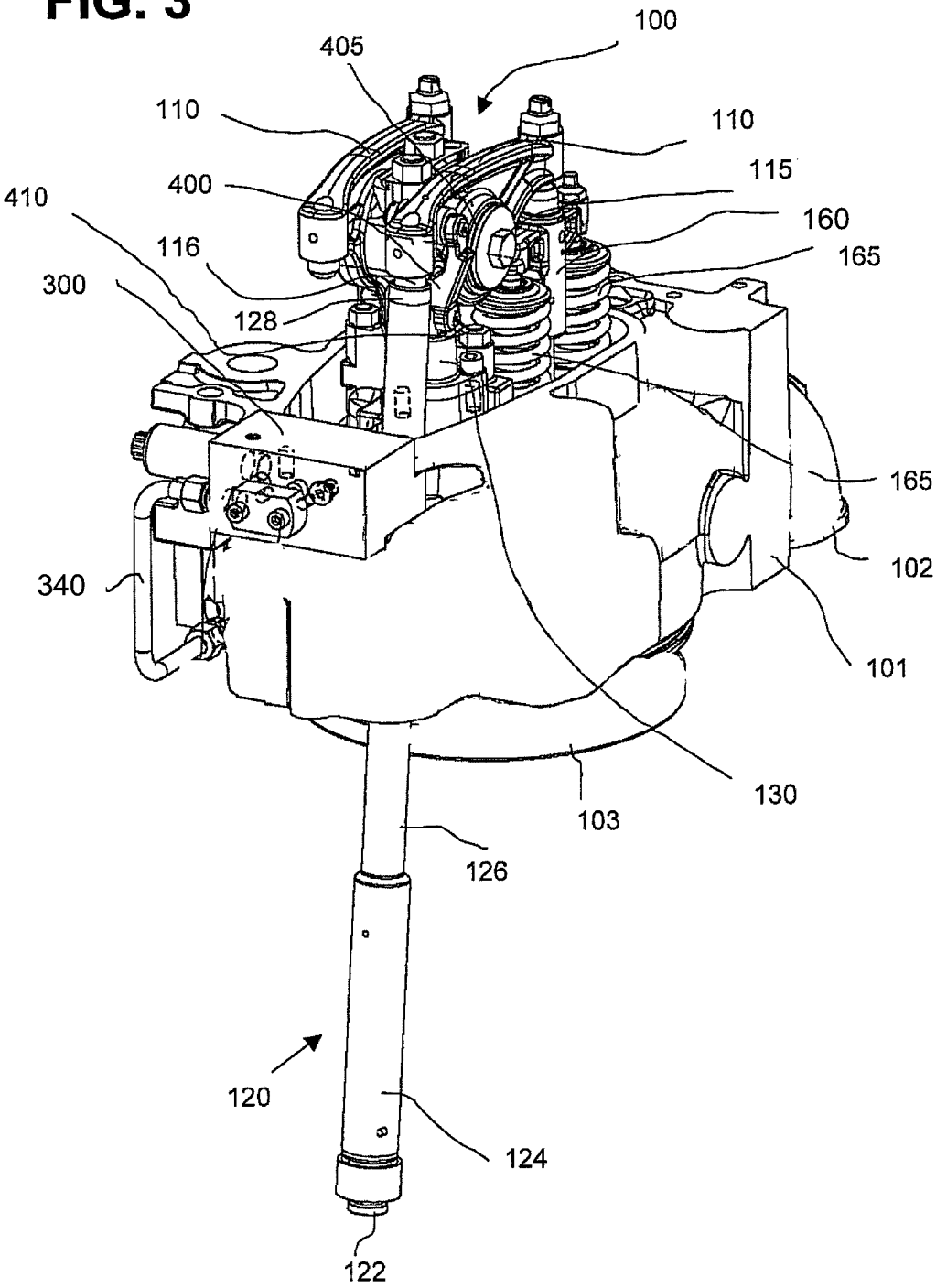
FIG. 3 is a perspective view of a second exemplary device for variably controlling the closing of inlet and/or exhaust valves of an internal combustion engine.

In FIGS. 2 and 3, one exemplary embodiment the hydraulic system 300 is schematically shown. This hydraulic system 300 may be in fluid communication with the damping unit 130 of FIG. 1. The hydraulic system 300 may include a control valve or shut-off valve 310, an throttle 315 and a check valve 320. This elements 310, 315 and 320 may be arranged in parallel by fluid supply lines 305, 330. In one exemplary embodiment the fluid supply lines 305, 330 may be adapted to supply oil and the throttle 315 may be adapted to be adjustable. As was already mentioned above, the supply line 305 may end in the fluid chamber 140 of the damper arrangement 130. The supply line 305 may also connect with the shut-off valve 310. In one exemplary embodiment the shut-off valve 310 may comprise a solenoid valve. It may be in fluid communication via the supply line 330 with a supply system 350 of the internal combustion engine. In one exemplary embodiment the supply system 350 may comprise a lubricating oil system.

The throttle 315 may connect with the supply line 305 and the oil-supply lines 330 and 340. The check valve 320 may also connect with the supply lines 305, 330 and may be arranged parallel to the throttle 315. Hence, the fluid, e.g. oil, can flow into a collecting reservoir 335 via a bleed line (also denotes as "blood-line"). The bleed line may be connected to the supply lines 330, 340. Finally, the supply lines 305, 330 and, hence, the valve 310, the throttle 315 and the check valve 320 are connected via the oil line 340 with e.g. the engine lubrication oil system 350 as is schematically illustrated. In FIG. 3 an lubricating oil inlet and outlet port 340 are shown.

Referring now to FIGS. 3-8, an exemplary embodiment of a valve control device 100 is explained in more details.

Figure 4:
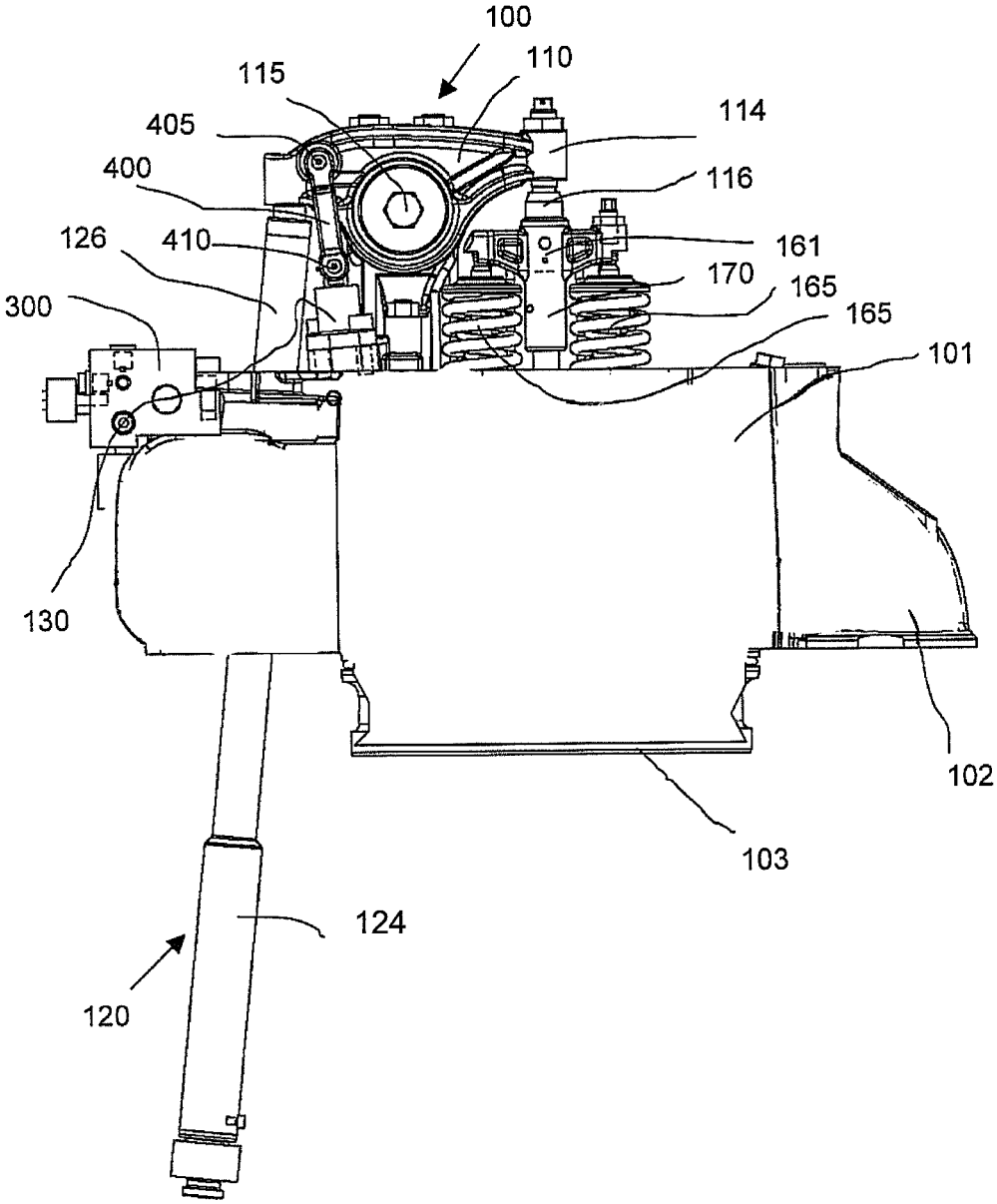
FIG. 4 is a side view of the device of FIG. 3.
Figure 5:
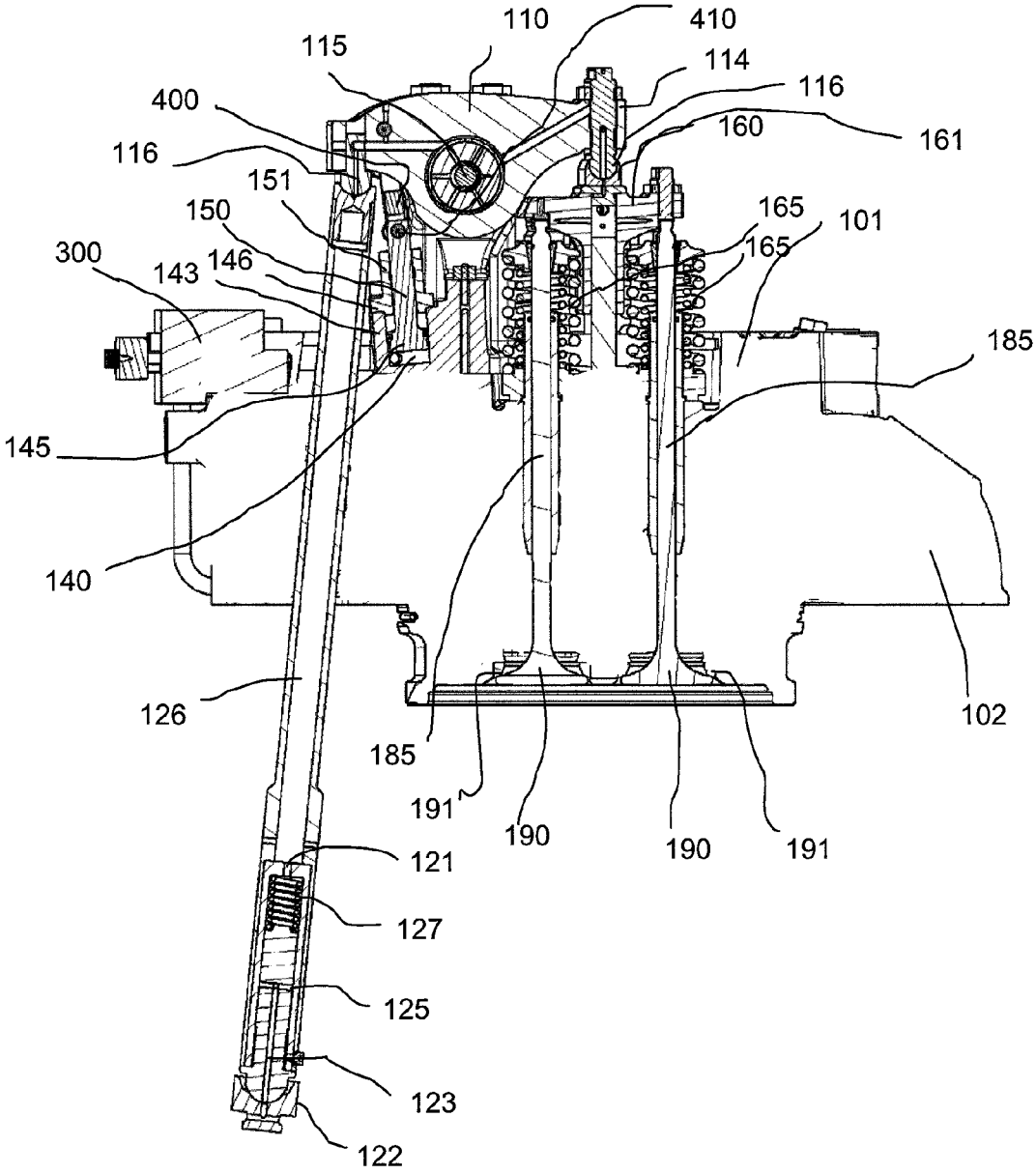
FIG. 5 is a sectional view of the device of FIGS. 3 and 4.

As shown in FIGS. 3 to 5, the device 100 includes the push-rod 120 having a connecting part 122, a telescoping device 124 for gap-compensating and a hollow rod member 126 closed by a cap 128. Referring to FIG. 5, further details of the telescoping member 124 of the push-rod 120 will now be explained. In one exemplary embodiment, a rod part of the push-rod 120 is integral with the rod member 126 of the push-rod 120. The outer diameter of the rod part may be greater than the outer diameter of the rod member 126 for accommodating a cylindrical sleeve 125, which receives a helical spring 127 and a cap 123. The spring 127 may rest on a ring-shaped projection 121 of the cylindrical sleeve 125. On the opposite side of the helical spring 127, the helical spring 127 urges against the cap 123. The outer end of the cap 123 may be hemispherical. Due to the telescoping device 124, any gap or play occurring during pivoting of the rocker arm 110 may be compensated.

As shown in FIG. 3, in one exemplary embodiment two valve bridges 160 are pivotably arranged above a cylinder head 101 having an air inlet 102 and a connecting flange 103 for mounting the cylinder head 101 at an engine housing (not shown). For illustration purposes, only one push-rod 120 is shown. However, the second rocker arm 110 may be, like the first rocker arm 110, adapted to be driven by a push-rod 120. The second rocker arm 110 acts on a further valve actuation bridge (not shown) which contacts a pair of outlet valves (not shown). The second rocker arm 110 may also preferably include a damping device 130 like the first rocker arm 110 as shown in FIG. 3.

The first rocker arm 110 may be pivotably arranged about an axis 115 and its free end 114 may contact the valve actuation bridge 160. As can be seen in FIGS. 3 and 4 and, in particular in FIG. 5, in one exemplary embodiment two inlet valves 180 are adapted to rest on the respective seat 191 in the cylinder head 101. Each valve shaft 185 may be biased upwards by a valve spring 165. The arrangement of the valves 180 and their respective contacts with the valve actuation bridge 160 is basically known and therefore, a detailed explanation thereof is omitted.

The damping unit 130 shown in FIGS. 3-8 includes in one exemplary embodiment a guiding sleeve 146 sealingly arranged in the piston housing 143. The piston-rod 150 may extend through the guiding sleeve 146 and may be adapted to reciprocate within the guiding sleeve 146. A seal 151 arranged in the inner circumference of the guiding sleeve 146 may contact the outer surface of the piston-rod 150 such that an oil-leakage is prevented. As shown for example in FIG. 6, a joint 410 may be provided on the end 152 of the piston-rod 150. At this joint 410, a forked lever 400 may be rotatably connected to the piston-rod end 152. The forked lever 400 may have two fork parts 411. A bearing member 117 of the rocker arm 110 may be arranged between the two spaced apart fork parts 411. At this point, a joint connection 405 may be provided between the rocker arm 110 and fork parts 411. Due to this arrangement, the reciprocating motion of the piston-rod 150 may be transferred to the rocker arm 110 such that the rocker arm 110 rotates about the rotational axis 115.

Figure 6:
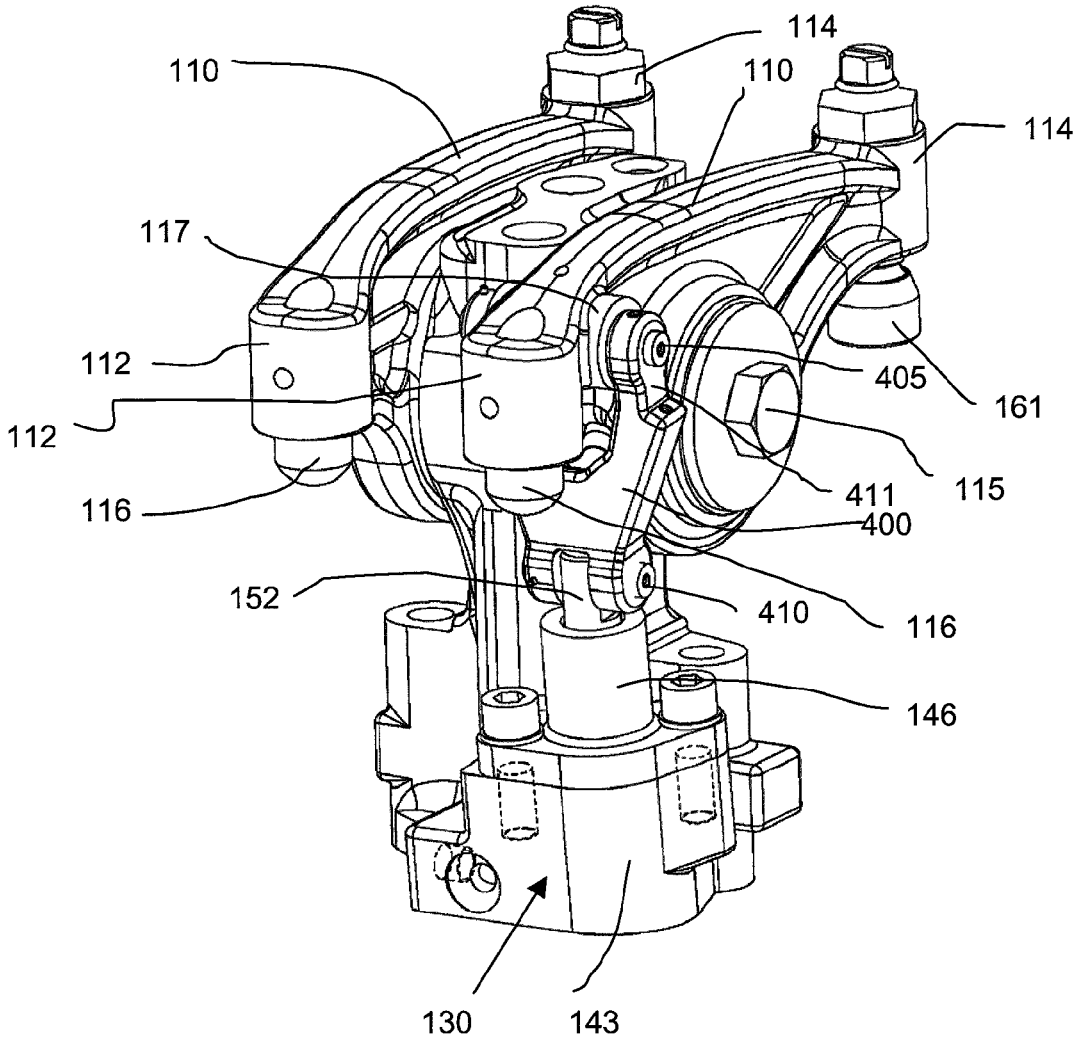
FIG. 6 is a perspective view of a part of the device shown in FIGS. 3-5.
Figure 7:
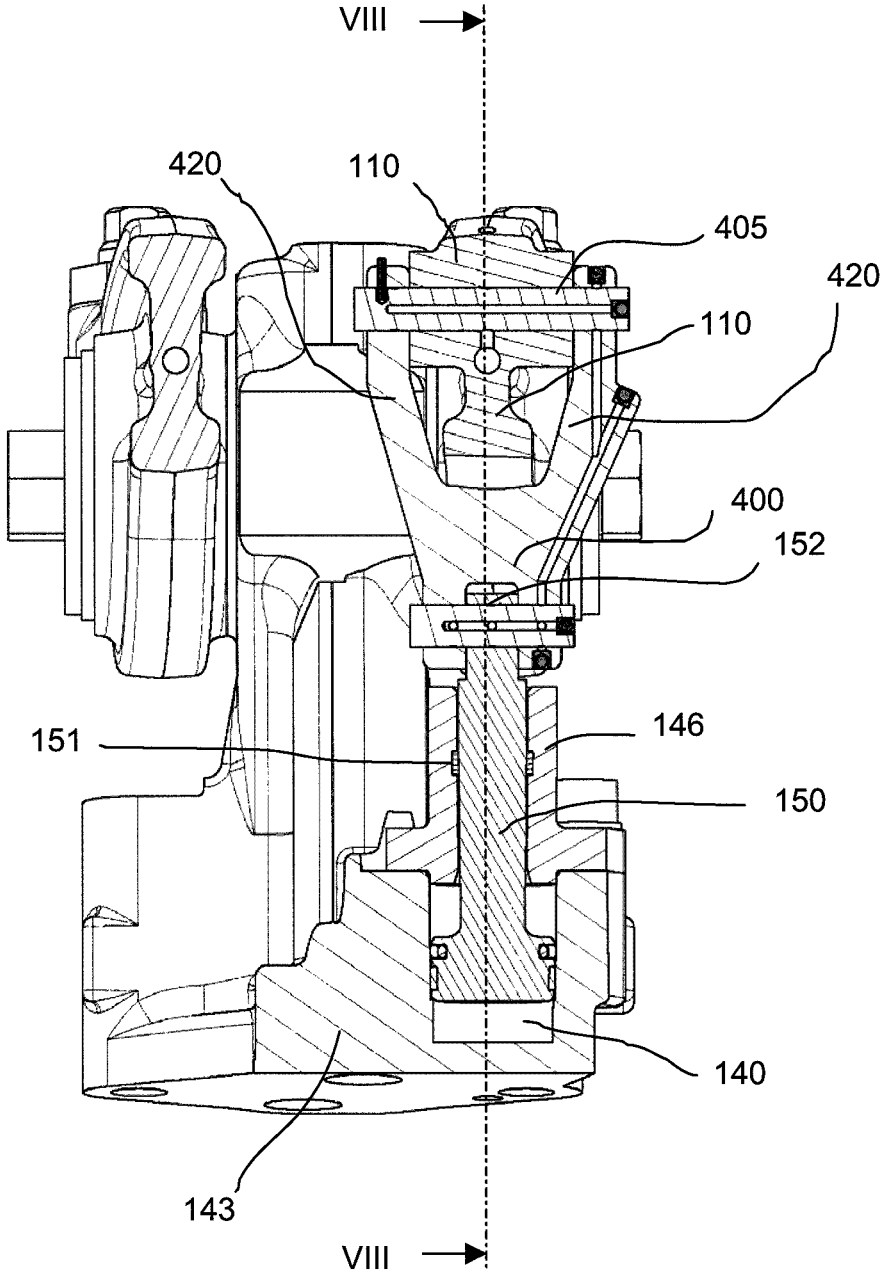
FIG. 7 is a sectional view of the device of FIG. 6.
Figure 8:
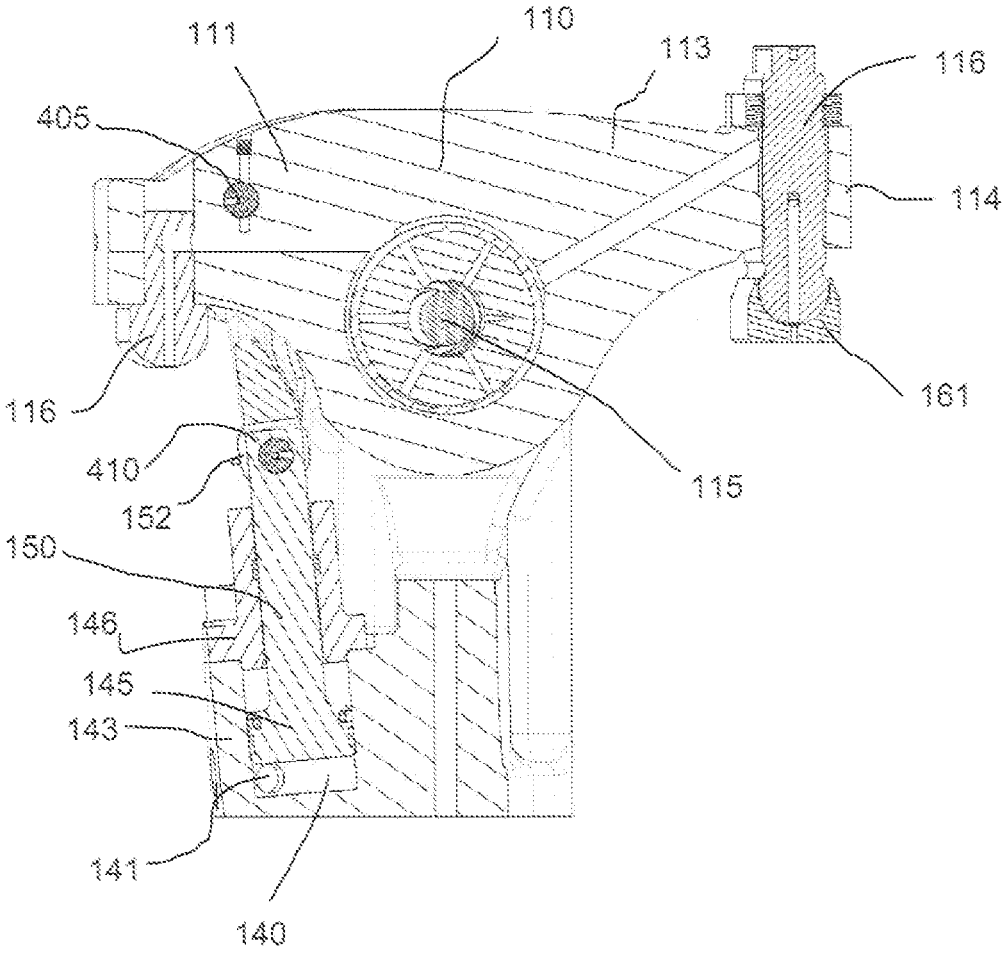
FIG. 8 is a sectional view along line VIII-VIII of FIG. 7.

A more detailed illustration of the assembly of the damping unit 130 and the rocker arm 110 is provided in FIGS. 6-8. As shown, in one exemplary embodiment the piston housing 143 includes the guiding sleeve 146. The end of the piston-rod 150 may extend through the guiding sleeve 146. The forked lever 400 may be rotatably connected to the end of the piston-rod 152 as well as to the first arm portion 111 of the rocker arm 110. In FIGS. 6 and 8, the contacting members 116 of the two rocker arms 110 are shown, which contacting members 116 may contact the push-rod 120 (see FIGS. 1, 3 and 4). The second free end 114 of the second arm portion 113 may have a contacting member 161, which in one exemplary embodiment is part of the rocker arm 110 or of the valve actuation bridge 160.

INDUSTRIAL APPLICABILITY

Referring to FIGS. 1 and 2, an exemplary embodiment of a method for operating the exemplary embodiment of an apparatus 100 for variable controlling at least one engine valve 180 shown e.g. in FIGS. 3-8 will now be explained.

During normal operation, the push-rod 120 is actuated by a valve cam and a rotational drive (both not shown), thereby rotating the rocker arm 110 around the rotational axis 115. During the upward movement of the push-rod 120, the rocker arm 110 is urged to rotate around rotational axis 115 as indicated by arrow 215. As a result, the valve actuation bridge 160, which is vertically movably supported by the guide rod 170, is being pivotably displaced or rotated against the biasing force of the valve springs 165 and the two intake valves 180 open in parallel, i.e. the valve discs 190 move away from the respective valve seats 191, as shown in FIG. 5. Consequently, during the downward movement of the valve actuation bridge 160, the piston-rod 150 of the damping unit 130 is urged to move upwards due to the joint connection with the first arm portion 111 of the rocker arm 110 via the forked lever 400. At the same time, the volume of the fluid chamber 140 increases and pressurized motor lubricating oil fills this increasing volume in an unthrottled manner via the oil-supply line 305 and the shut-off/passage valve 310, because the check valve 320 is opened in the filling direction and the shut-off/passage valve 310 is in the position shown in FIG. 2. As a result, the pivoting of the rocker arm 110 in the direction indicated by arrow 215 may not delayed. In particular, the positive connection, e.g., the pivot connection or hinge connection with the rocker arm 110 via, e.g., the lever 400 may generate a suction effect in the fluid chamber 140 for at least assisting the filling process of the fluid chamber 140 with fluid. Consequently, the filling process of the chamber with hydraulic fluid may be improved. In another exemplary embodiment the pivoting of the rocker arm 110 in the direction indicated by arrow 215 may be delayed with the aid of the damper arrangement 130.

The biasing force of the valve springs 165 may cause the valves 180, the valve actuation bridge 160, the rocker arm 110, the push-rod 120 to remain in series connection during this time.

The closing of the intake valves 180 may be initiated when the not-illustrated rotational drive and the push-rod 120 move downward in accordance with the further rotation of the not-illustrated cam profile. At this time, the valve actuation bridge 160 may be displaced upward by e.g. the biasing force of the valve springs 165, whereby the volume in the fluid chamber 140 may be reduced and the lubricating oil located in the fluid chamber 140 is discharged to the lubricating oil-supply system 350 via the oil-supply lines 305 and 340 in an unthrottled throttle manner via the opened shut-off/passage valve 310. On the other hand, when the shut-off/passage valve 310 is closed, i.e. in the shut-off position during the closing motion of the intake valves 180, the discharge of the lubricating oil from the fluid chamber 140 no longer takes place in an unthrottled manner via the shut-off/passage valve 310. Instead, the lubricating oil may be discharged via the throttle 315. Consequently, the upward movement of the valve actuation bridge 160 may be hindered, damped or delayed because the cross section of the throttle 315 is restricted. As a result, in one embodiment the upward stroke of the valve actuation bridge 160 and, consequently, the closing of the intake valves 180 may be damped/delayed by e.g. reducing the throttle cross section of the throttle 315.

Due to the arrangement and construction explained above and shown in the figures, in one exemplary embodiment a predetermined damping of the closing of the inlet and/or exhaust valves 180 can be achieved. Contrary to the known art, in which the delay device is integrated in the valve actuation bridge and the associated guide rod, the presently preferred embodiment maybe used for e.g. two and/or e.g. four valve cylinder heads with or without a guide-rod because in one exemplary embodiment the damper arrangement is disposed on the same side of the rocker arm 110 as the push-rod 120. Therefore, in one exemplary embodiment the damper arrangement 130 may be installed independently of the structure and design of the valve actuation bridge. A further advantage may be that maintenance of the valve control devices 100 is easier than of prior art devices, because in one exemplary embodiment for example the damper arrangement may be replaced without substantial disassembly.

Although the preferred embodiments of this disclosure have been described herein, improvements and modifications may be incorporated without departing from the scope of the following claims.

The invention claimed is:

1. An apparatus for controlling valve displacement of an internal combustion engine comprising:

a rocker arm having a first arm portion and a second arm portion, said rocker arm being pivotable about a pivot interposed between said first and second arm portions;

an actuation arrangement adapted to actuate, and being in contact with, said first arm portion of said rocker arm;

a valve arrangement adapted to be actuated by, and being in contact with, said second arm portion of said rocker arm;

a damper arrangement pivotably connected to said first arm portion at a joint connection located between the pivot and a free end of the first arm portion to move responsive to movement of said first arm portion when rotating in a first rotating direction and a second rotating direction, and adapted for damping movement of said rocker arm around said pivot;

said damper arrangement is hydraulically operated means of a hydraulic fluid, the damper arrangement being pivotably connected to said first arm portion so that movement in said first rotating direction of said rocker arm around said pivot is damped and during movement in said second rotating direction of said rocker arm said hydraulic fluid is sucked.

2. The apparatus according to claim 1, wherein:

the actuation arrangement comprises a push rod adapted to be reciprocated, and the first arm portion extends from the pivot to the free end, which is a first free end, of the rocker arm and the second arm portion extends from the pivot to a second free end of the rocker arm opposite the first free end, wherein the first arm portion of the rocker arm is adapted to be driven by reciprocating movement of said push rod.

3. The apparatus according to claim 2, wherein:

said valve arrangement comprises a valve actuation bridge adapted to be driven by said second arm portion of said rocker arm, said valve actuation bridge being connected to valve shafts of said valves, and said valve arrangement comprises inlet and/or exhaust valves.

4. The apparatus according to claim 3, wherein said rocker arm is pivotable about said pivot in the first rotating direction and the second rotating direction which is reverse to the first rotating direction.

5. An apparatus for controlling valve displacement of an internal combustion engine comprising:

a rocker arm having a first arm portion and a second arm portion, said rocker arm being pivotable about a pivot interposed between said first and second arm portions;

an actuation arrangement adapted to actuate said first arm portion of said rocker arm;

a valve arrangement adapted to be actuated by said second arm portion of said rocker arm;

a damper arrangement pivotably connected to said first arm portion at a joint connection located between the pivot and a first free end of the first arm portion, and adapted for damping movement of said rocker arm around said pivot;

the actuation arrangement comprises a push rod adapted to be reciprocated, and the first arm portion extends from the pivot to the first free end of the rocker arm and the second arm portion extends from the pivot to a second free end of the rocker arm opposite the first free end, wherein the first arm portion of the rocker arm is adapted to be driven by reciprocating movement of said push rod;

said valve arrangement comprises a valve actuation bridge adapted to be driven by said second arm portion of said rocker arm, said valve actuation bridge being connected to valve shafts of said valves, and said valve arrangement comprises inlet and/or exhaust valves;

said rocker arm is pivotable about said pivot in the first rotating direction and the second rotating direction which is reverse to the first rotating direction;

said damper arrangement is hydraulically operated by means of a hydraulic fluid, the damper arrangement being pivotably connected to said first arm portion so that movement in said first rotating direction of said rocker arm around said pivot is damped and during movement in said second rotating direction of said rocker arm said hydraulic fluid is sucked;

said damper arrangement is adapted to apply a pushing force to said first arm portion of said rocker arm for damping the rotation movement of said rocker arm in said first rotational direction during closing of said inlet and/or exhaust valves, and said damper arrangement is adapted to suction said hydraulic fluid during the rotation movement of said rocker arm in said second rotational direction during the opening of the inlet and/or exhaust valves.

6. An apparatus for controlling valve displacement of an internal combustion engine comprising:

a rocker arm having a first arm portion and a second arm portion, said rocker arm being pivotable about a pivot interposed between said first and second arm portions;

an actuation arrangement adapted to actuate said first arm portion of said rocker arm;

a valve arrangement adapted to be actuated by said second arm portion of said rocker arm;

a damper arrangement pivotably connected to said first arm portion at a joint connection located between the pivot and a first end of the fast arm portion and adapted for damping movement of said rocker arm around said pivot;

the actuation arrangement comprises a push rod adapted to be reciprocated, and the first arm portion extends from the pivot to the first free end of the rocker arm and the second arm portion extends from the pivot to a second free end of the rocker arm opposite the first free end, wherein the first arm portion of the rocker arm is adapted to be driven by reciprocating movement of said push rod;

said valve arrangement comprises a valve actuation bridge adapted to be driven by said second arm portion of said rocker arm, said valve actuation bridge being connected to valve shafts of said valves, and said valve arrangement comprises inlet and/or exhaust valves;

said rocker arm is pivotable about said pivot in the first rotating direction and the second rotating direction which is reverse to the first rotating direction;

said damper arrangement is hydraulically operated by means of a hydraulic fluid, the damper arrangement being pivotably connected to said first arm portion so that movement in said first rotating direction of said rocker arm around said pivot is damped and during movement in said second rotating direction of said rocker arm said hydraulic fluid is sucked;

the damper arrangement is adapted to apply a force to the first arm portion of the rocker arm for damping the rotation movement of said rocker arm in said first rotational direction during closing of the inlet and/or exhaust valves, and the damper arrangement is adapted to suction said hydraulic fluid during the rotation movement of said rocker arm in said second rotational direction the opening of the inlet and/or exhaust valves.

7. The apparatus according to claim 6, wherein:

the damper arrangement includes a housing, a piston having a piston rod and being displaceably arranged in the housing and a fluid chamber formed by the housing and the piston and adapted to be filled with a pressurized fluid, and the piston rod is pivotably attached to the first arm portion of the rocker arm.

8. The apparatus according to claim 7, wherein said housing is an integral part of a cylinder head of the internal combustion engine.

9. An apparatus for controlling valve displacement of an internal combustion engine comprising:

a rocker arm having a first arm portion aid a second arm portion, said rocker arm being pivotable about a pivot interposed between said first and second arm portions;

an actuation arrangement adapted to actuate said first arm portion of said rocker arm;

valve arrangement adapted to be actuated by said second arm portion of said rocker arm;

a damper arrangement pivotably connected to said first arm portion and adapted for damping movement of said rocker arm around said pivot;

the actuation arrangement comprises a push rod adapted to be reciprocated, and the first arm portion extends from the pivot to a first free end of the rocker arm and the second arm portion extends from the pivot to a second free end of the rocker opposite the first free end, wherein the first arm portion of the rocker arm is adapted to be driven by reciprocating movement said push rod;

said valve arrangement comprises a valve actuation bridge adapted to be driven by said second arm portion of said rocker arm, said valve actuation bridge being connected to valve shafts of said valves, and said valve arrangement comprises inlet and/or exhaust valves;

said rocker arm is pivotable about said pivot in the first rotating direction and the second rotating direction which is reverse to the first rotating direction;

said damper arrangement is hydraulically operated by means of a hydraulic fluid, the damper arrangement being pivotably connected to said first arm portion so that movement in said first rotating direction of said rocker arm around said pivot is damped and during movement in said second rotating direction of said rocker said hydraulic fluid is sucked;

the damper arrangement is adapted to apply a force to the first arm portion of the rocker arm for damping the rotation movement said rocker arm in said first rotational direction during closing of the inlet and/or exhaust valves;

the damper arrangement is adapted to suction said hydraulic fluid during the rotation movement of said rocker arm in said second rotational direction the opening of the inlet and/or exhaust valves;

the damper arrangement includes a housing, a piston having a piston rod and being displaceably arranged in the housing and a fluid chamber formed by the housing and the piston and adapted to be tilled with a pressurized fluid;

the piston rod is pivotably attached to the first arm portion of the rocker arm;

wherein said housing is an integral part of a cylinder head of the internal combustion engine; and further comprising a forked lever having a base and a pair of fork parts, the forked lever connecting the piston-rod to the first arm portion of the rocker arm, the base of the forked lever being pivotably connected to the piston-rod and the fork parts of the forked lever being pivotably connected to the first arm portion of the rocker arm.

10. The apparatus according to claim 9, wherein:

said push-rod includes a gap-compensating telescoping device, said first arm portion of the rocker arm being driven by said push rod via the gap-compensating telescoping device, and optionally, said gap-compensating telescoping device is integrated in said push-rod.

11. The apparatus according to claim 1, further comprising a shut-off/passage valve, a throttle and a check valve arranged in parallel with each other, wherein a first connection of the shut-off/passage valve, a first connection of the throttle and a first connection of the check valve are in fluid communication with said fluid chamber via a first oil-supply line, and wherein a second connection of the shut-off/passage valve, a second connection of the throttle and a second connection of the check valve are in fluid communication with an oil supplying system via a second oil-supply line.

12. A method of controlling at least one combustion chamber valve associated with a rocker arm, the method comprising:

actuating at least one combustion chamber valve to open by applying a force to a first arm portion of said rocker arm for rotating said rocker arm in a second rotating direction about a pivot interposed between said first arm portion and a second arm portion, said second arm portion being adapted to actuate at least one combustion chamber valve, closing the at least one combustion chamber valve by rotating said rocker arm in a first rotating direction, which is opposite the second rotating direction, responsive to a force from a valve spring; and damping rotation of said rocker arm in the first rotating direction using a damper arrangement pivotably connected to said first arm portion of said rocker arm at a joint connection located between the pivot and a free end of the first arm portion;

wherein said damper arrangement is hydraulically operated by means of a hydraulic fluid, said method further comprising:

rotating said rocker arm about said pivot in said first rotating direction and simultaneously applying a force to said first arm portion of said rocker arm so that movement of said rocker arm around said pivot in said first rotating direction is damped, and rotating the rocker arm about said pivot in the second rotating direction and simultaneously sucking said hydraulic fluid.

13. The method according to claim 12, wherein the step of closing of said combustion chamber valve is delayed by said damper arrangement.

14. The method according to claim 13, wherein a force is applied to said first arm portion of the rocker arm, thereby delaying pivoting movement of the rocker arm in a valve-closing direction.

15. An internal combustion engine having an apparatus for controlling valve displacement of said internal combustion engine, wherein the apparatus comprises a rocker arm, said rocker arm being pivotable about a pivot interposed between first and second arm portions, an actuation arrangement for applying a force to said first arm portion of said rocker arm, a valve arrangement actuated by said second arm portion of said rocker arm and a damper arrangement pivotably connected to, and in contact with, said first arm portion at a joint connection located between the pivot and a free end of the first arm portion and damping a movement of said rocker arm around said pivot; and said damper arrangement is hydraulically operated by means of a hydraulic fluid, the damper arrangement being pivotably connected to said first arm portion so that movement in said first rotating direction of said rocker arm around said pivot is damped and during movement in second rotating direction of said rocker arm said hydraulic fluid is sucked.

* * * * *